United States Patent [19]

Boturla

[11] Patent Number: 4,557,176

[45] Date of Patent: Dec. 10, 1985

[54] PRACTICE DRUMSTICK

[76] Inventor: Alan Boturla, 268 Semel Ave., Garfield, N.J. 07026

[21] Appl. No.: 700,498

[22] Filed: Feb. 11, 1985

[51] Int. Cl.[4] ..... G10D 13/02

[52] U.S. Cl. ..... 84/422 S; 84/411 P; 84/465

[58] Field of Search ..... 84/422, 411 D, 465

[56] References Cited

U.S. PATENT DOCUMENTS

| | | | |
|---|---|---|---|
| 3,146,659 | 9/1964 | Robba et al. | 84/422 S |
| 3,301,119 | 1/1967 | Gilbert | 84/422 S |
| 4,202,241 | 5/1980 | Lucas | 84/422 S |
| 4,271,745 | 6/1981 | Shatto | 84/402 |

*Primary Examiner*—Lawrence R. Franklin

*Attorney, Agent, or Firm*—Joseph A. Giampapa; Melvin K. Silverman

[57] ABSTRACT

A drumstick having an elongated, hollow, non-tapered body portion with a closed, rounded striking tip at one end and an open, non-tipped portion at the opposite end. The manner of practice playing is the same as that used in conventional live performance drumplaying, i.e., the drummer strikes the drum skin with the drumstick tip in reciprocating fashion; however, the drumstick of the instant invention may employ either end of the stick to strike the acoustical surface. The present drumstick produces a substantially quieter sound characteristic, thus allowing one to practice drumplaying skills while not disturbing others in proximity to the practice site.

7 Claims, 6 Drawing Figures

PRACTICE DRUMSTICK

BACKGROUND OF THE INVENTION

The present invention relates to a practice drumstick and its method of use.

The conventional solid wooden drumstick ranges from about 15" to 18" in length and includes butt, shaft and tip portions, the butt and shaft constituting roughly 85% of the total length, with the remaining 15% tapering to a tipped endpoint. Such a drumstick has long been the most widely used type of drumstick in the percussion field. The popularity of the wooden drumstick is based upon its optimal mix of characteristics with respect to sound production, weight, distribution of weight, durability, flexibility, resilience, shock absorbability and overall "feel." Wooden drumsticks nonetheless suffer from certain inherent disadvantages, chief among them being chipping, splintering, cracking and warpage.

The prior art is replete with examples of other and non-conventional drumsticks directed toward better fulfilling one or more of the above design or performance criteria while attempting to avoid the inherent disadvantages of solid wooden drumsticks.

U.S. Pat. No. 4,300,438 to Handel, for example, discloses drumsticks made of woven cotton fabric impregnated with phenolic resin. Such drumsticks are said to possess superior durability, weight and stability, and to exhibit better resilience, flexibility and percussion absorbability. Heiskell's U.S. Pat. No. 4,305,544 is another example of the impregnated, woven-fabric type of drumstick.

Yet others, such as Cordes in U.S. Pat. No. 3,722,350, have attempted to substitute metallic material for conventional hard woods, and introduced the hollowed-out, rather than solid, body portion. Such approaches claim to achieve a sound and feel comparable to wood but with an improved durability quotient.

Lucas, in U.S. Pat. No. 4,202,241, represents the school of drumstick innovators that emphasize the use of plastic as the primary component material. Plastic drumsticks produce a lighter, brighter sound and overcome the breakage problem of wooden sticks; however, while stronger than wood, plastic is also much heavier.

The weight problem of plastic drumsticks has been addressed by hollowing out the longitudinal body portion, then adding back structural ribs (see U.S. Pat. No. 4,202,241 to Lucas), longitudinal reinforcing fibers (see U.S. Pat. No. 3,489,052 to Coyler et. al.), or both structural ribs and reinforcing fibers (see U.S. Pat. No. 3,958,485 to Peters).

Thus, the present state of the drumstick art provides a wide variety of so-called performance sticks, ranging from the simple one-piece, solid wooden stick to sophisticated multi-piece, metal plastic combinations of varying size, shape and color. All of the prior art drumsticks, however, share the common goal of optimizing, through tradeoffs, the properties of tonal reproduction, weight, weight distribution, durability, flexibility, resilience, shock absorbability and overall feel. This path of drumstick development has obscured a longstanding and practical problem in the percussion field; namely, the production of a drumstick whose primary attribute is quietness.

By focusing on substantially reducing the sound produced by the stick, an emphasis very much counterintuitive to the usual purpose of a drumstick, I have developed a drumstick suitable for practice playing use while retaining the basic size, shape and overall feel of performance sticks, thus serving to keep one's performing skills sharp. At the same time, I significantly decrease sound output so as not to disturb others engaged in routine living activities, such as watching television. This difference in function is the basis for the below set forth differences in structure which distinguish the instant invention both from the relevent prior art and other arts such as police billy clubs, pool cues, golf clubs, baseball bats, and pencil and pen housings.

The invention is believed to be properly classified in Class 84, Subclass 422 S.

SUMMARY OF THE INVENTION

This invention relates generally to drumsticks and, more specifically, to a novel type of drumsticks suited for practice playing rather than live performances.

The method of practice drumstick playing set forth herein comprises the step of reciprocatingly striking an acoustical surface with an elongate, hollow, cylindrical rod formed of a radially resilient material, said rod having a closed, rounded striking tip at one end and an open tip at the other end thereof.

The principal object of the invention is to provide a drumstick which greatly reduces the sound output normally attendant to drum playing, to facilitate the practicing of drum playing skills while at the same time not disturbing others engaged in the course of daily living activities.

It is a further object to provide a means for practicing drum playing skills which simulates the actual function of playing drums, in contrast to practice on a mere drum pad.

It is a still further object of the invention to provide a practice drumstick which is longer-lasting, yet less expensive, than performance drumsticks presently available in the market place.

Other objects and advantages of the invention will become apparent from the Detailed Description and Drawing which follow. It is to be understood, however, that the invention is not limited to the embodiment described and illustrated below, as it may be embodied in other forms.

DETAILED DESCRIPTION OF THE INVENTION

Figure 1:
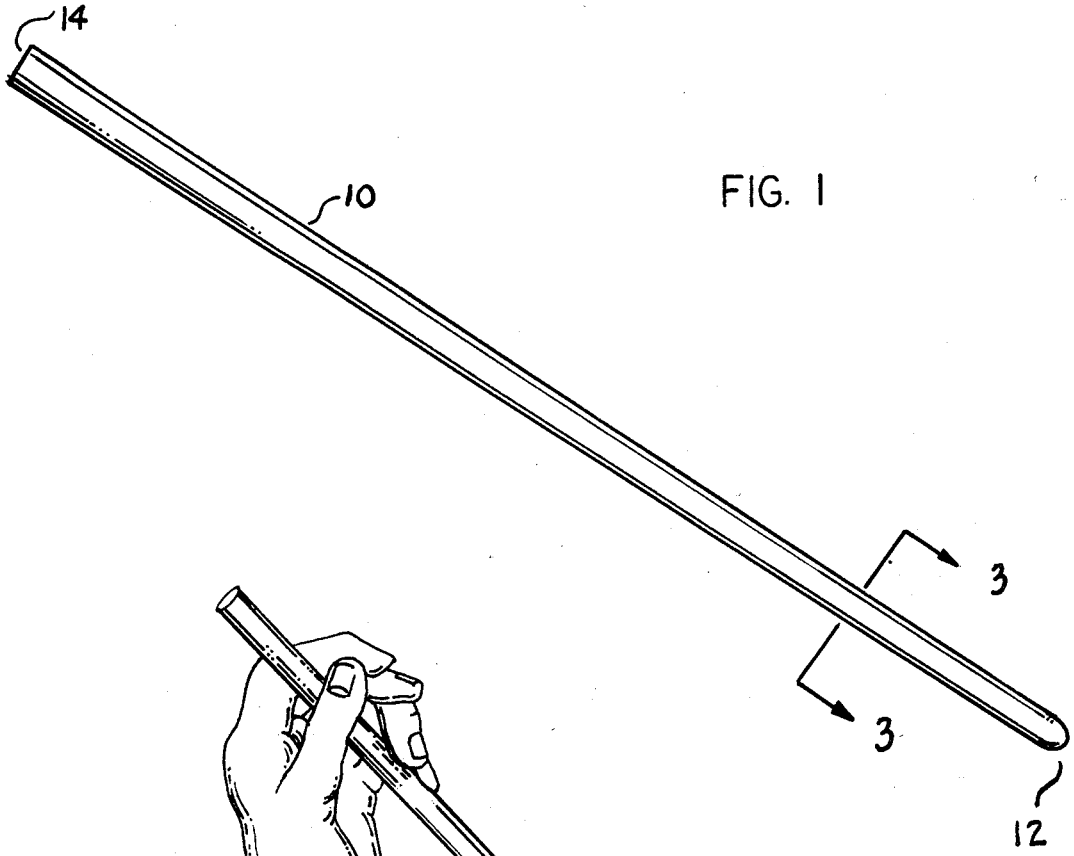
FIG. 1 is a perspective view of the inventive practice drumstick.
Figure 3:
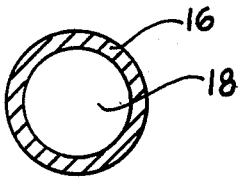
FIG. 3 is a radial, cross-sectional view taken along Line 3—3 of FIG. 1.

Referring to FIG. 1, there is shown the inventive drumstick's body portion 10, the closed, rounded striking tip 12 at one end, and the open, non-tipped alternate striking section 14 at the opposite end. The body portion is not tapered. It is made of a radially resilient material such as a thermoplastic, and may range in density from 0.7 grams per cubic centimeter to 1.2 grams per cubic centimeter. The body portion 10 has an interior diameter 18 (see FIG. 3), which may range from 10 to 20 millimeters, has a substantially constant wall thickness 16 (see FIG. 3) in the range of 0.5 millimeters to 1.0 millimeters, and has a longitudinal length of between 400 and 500 millimeters. The drumstick's center of gravity is located approximately 53% of the length from its open-ended tip, and the weight of the drumstick is in the range of 10 to 20 grams.

In a preferred embodiment, the drumstick is formed of polyurethane, polystyrene, or polyvinylchloride plastic and possesses a length of 433 millimeters; a weight of 15.5 grams, an interior diameter of 15.6 millimeters; a wall thickness of 0.76 millimeters; and a density of 0.93 grams per cubic centimeter.

Figure 2:
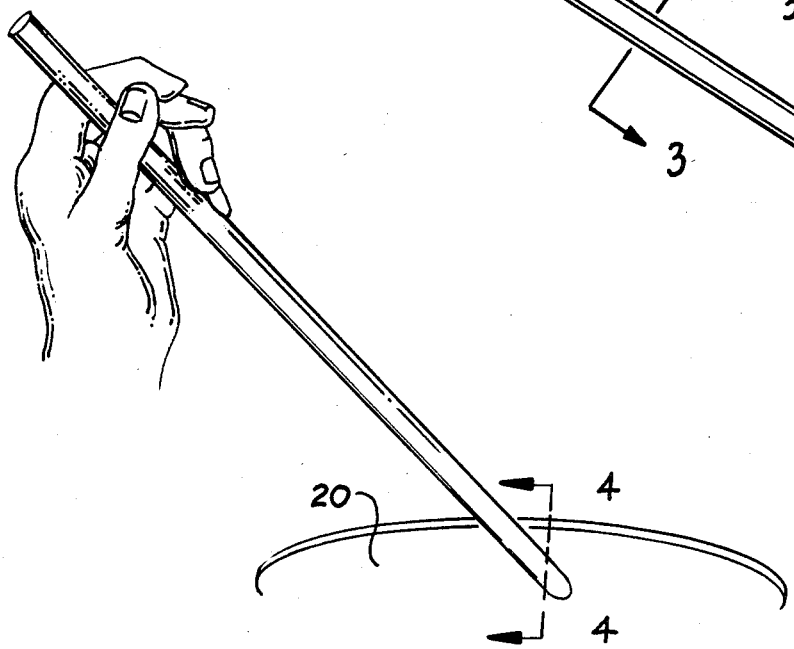
FIG. 2 is a perspective, operational view of said practice drumstick, demonstrating the use of the closed end thereof.
Figure 4:
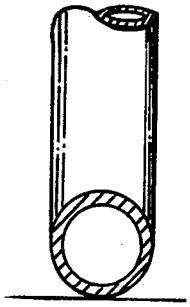
FIG. 4 is a cross-sectional, breakaway view taken along Line 4—4 of FIG. 3.

FIG. 2 shows the instant drumstick as it would be held in a drummer's hand, wherein use of the closed, rounded striking tip 12 is being made to strike the acoustical surface 20. FIG. 4 is a cross-sectional, breakaway representation of the closed end tip 12 coming into contact with the acoustical surface 20.

Figure 6:
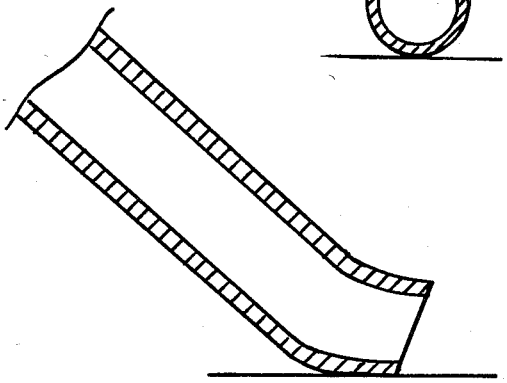
FIG. 6 is a cross-sectional, partial breakaway, longitudinal view, illustrating the deformation of the stick wall at the point of contact with the acoustical surface.
Figure 5:
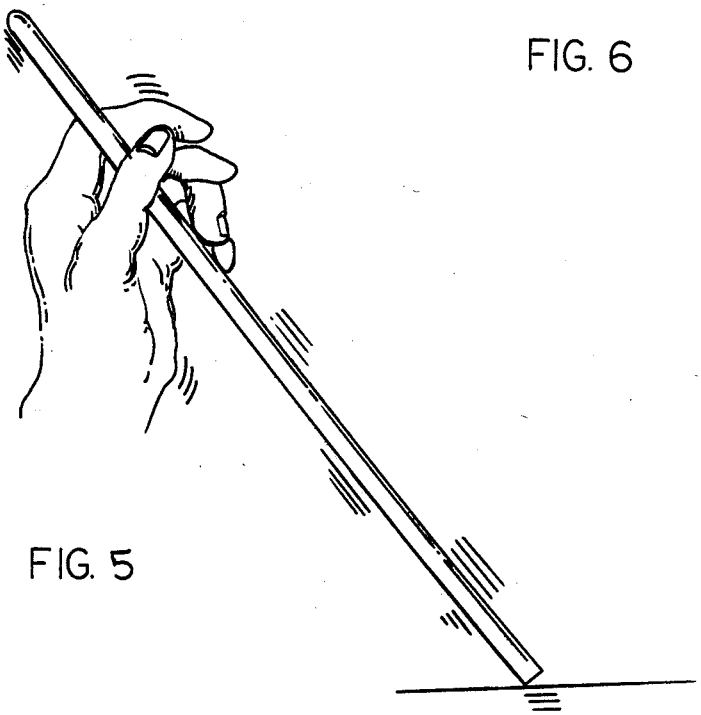
FIG. 5 is a perspective, operational view of said practice drumstick, demonstrating the use of the open end thereof.

It is to be appreciated that because of the resilience of the material from which the stick is fashioned, there is necessarily some degree of radial deflection when striking the acoustical surface. This is most clearly illustrated in FIG. 5, showing the deflection from striking with the open, non-tipped striking section 14. A closer view of such deflection, at the moment of striking, is shown in FIG. 6. This radial deflection is in the range of 10 to 20 degrees.

The present practice drumstick is used in the same manner as a conventional drumstick; namely, by reciprocatingly striking an acoustical surface. It is suitable for use with conventional drumheads made of plastic, Mylar, and natural calf-skin; for use with conventional metal surfaces, such as cymbals, cow bells, drum rims, and chamber bells; and for use with electronic drums having rubber heads, such as snare drums and Simmons drum pads. The instant drumsticks, being simulative of playing upon an actual drum skin membrane, permit the user to approximate live performing much more closely than practice on a mere drum pad.

Moreover, the inventive sticks can be clear or opaque in color, and they are reversible. That is, either end—the closed, rounded tip end 12 or the open, non-tipped end 14—can be used for striking. Use of the open end will result in maximum sound reduction.

It is to be understood that while there have been shown and described the preferred embodiments of the invention, the invention may be embodied otherwise than is herein specifically shown or described and that in such other embodiments certain changes in the detail of construction, or in the form and arrangement of the parts, may be made without departing from the underlying idea or principles of this invention within the scope of the appended claims.

Having thus described my invention, what I claim is:

1. A drumstick for practice drum playing comprising an elongated, hollow, non-tapered body portion made of a radially resilient material, ranging in density from 0.7 grams per cubic centimeter to 1.2 grams per cubic centimeter, having an interior diameter of between 10 and 20 millimeters, and having a substantially constant wall thickness of between 0.5 and 1.0 millimeters, said body portion having a closed, rounded striking tip at one end and an open, non-tipped section, also capable of striking, at the opposite end thereof.

2. The drumstick as recited in claim 1 having a length of between 400 and 500 millimeters, and a weight of between 10 and 20 grams.

3. The drumstick recited in claim 1 in which said resilient material is a thermoplastic selected from the group consisting essentially of polyurethane, polystyrene and P.V.C. tubing.

4. The drumstick recited in claim 3 having a typical radial deflection of its longitudinal axis, at the moment of striking.

5. The drumstick recited in claim 3 having a clear color.

6. The drumstick recited in claim 3 having an opaque color.

7. The drumstick recited in claim 1 havng a center of gravity located at a point approximately 53% of its length from said open-ended tip.

* * * * *